US012571409B2

(12) United States Patent
Mathuria et al.

(10) Patent No.: US 12,571,409 B2
(45) Date of Patent: Mar. 10, 2026

(54) HYBRID SHROUD IMPELLER

(71) Applicant: Raytheon Technologies Corporation, Farmington, CT (US)

(72) Inventors: Parag H Mathuria, Palm Beach Gardens, FL (US); Lajos H. Horvath, Jupiter, FL (US); Tsing-yi Liu, Palm City, FL (US)

(73) Assignee: RTX Corporation, Farmington, CT (US)

( * ) Notice: Subject to any disclaimer, the term of this patent is extended or adjusted under 35 U.S.C. 154(b) by 271 days.

(21) Appl. No.: 18/207,907

(22) Filed: Jun. 9, 2023

(65) Prior Publication Data

US 2024/0410392 A1 Dec. 12, 2024

(51) Int. Cl.
*F04D 29/32* (2006.01)
*F04D 29/38* (2006.01)
*F04D 29/52* (2006.01)

(52) U.S. Cl.
CPC ..... *F04D 29/526* (2013.01); *F04D 29/326* (2013.01); *F04D 29/384* (2013.01)

(58) Field of Classification Search
CPC ..... F04D 29/526; F04D 29/326; F04D 29/384
See application file for complete search history.

(56) References Cited

U.S. PATENT DOCUMENTS 10,710,160 B2 7/2020 Army et al.
10,865,647 B2 12/2020 Tozzi et al.
11,130,174 B2 9/2021 Notarnicola et al.
11,313,379 B2 * 4/2022 Iwakiri ..... F04D 29/162
11,448,230 B2 9/2022 Giannozzi et al.
2008/0292464 A1 11/2008 Keber et al.
2012/0102969 A1 5/2012 Wagner et al.
2018/0266433 A1 9/2018 Iurisci et al.
2020/0063749 A1 2/2020 Iwakiri et al.

FOREIGN PATENT DOCUMENTS

CN 112360761 A 2/2021
JP 2013053524 A 3/2013

OTHER PUBLICATIONS

Extended European Search Report for counterpart EP Application No. 24180740.3 dated Nov. 5, 2024.

* cited by examiner

*Primary Examiner* — Sabbir Hasan
(74) *Attorney, Agent, or Firm* — Bachman & LaPointe, P.C.

(57) ABSTRACT

A hybrid shroud impeller including a hub having a first and a second axial end; the hub including an outer surface formed radially opposite a hub bore; a full blade extending radially from the outer surface; a splitter blade extending radially from the outer surface adjacent to the full blade; a bleed feature formed in a casing; a partial shroud integrally formed with a portion of the full blade and the splitter blade opposite the outer surface of the hub; a flow path formed between the outer surface of the hub, a shroud inner surface of the partial shroud and a blade surface of each of the full blade and the splitter blade; and the flow path extending from an inlet proximate the first axial end and an outlet proximate the second axial end; the partial shroud extends from the inlet to the bleed feature.

7 Claims, 4 Drawing Sheets

HYBRID SHROUD IMPELLER

BACKGROUND

The present disclosure is directed to an improved partially shrouded impeller.

Referring to FIG. 1, FIG. 2 and FIG. 3, a compressor impeller I is shown with no shroud connected to the impeller blades B.

The compressor impeller I is located within a casing C. The gap G between the impeller I and the casing C is required to be a predetermined value to meet performance requirements. During certain operational conditions the tips of the blades B can occasionally come into unwanted contact with the casing C. The contact can cause unwanted rubbing and abrasion that can require repair and maintenance. Impeller blade damage can occur from insufficient clearances. Additionally, abrasion can lead to corrosion which can promote unwanted wear. Impeller clearance cannot be directly measured and the impeller wheel is not designed for heavy rubs, so clearances are set conservatively. To avoid unwanted wear and potential damage, designers set the gap G conservatively, that is at greater dimensions to avoid the unwanted contact. The greater gap G dimensions may fail to optimize performance requirements. Designers also incorporate abradable materials into the tips of the blades B and/or casing C, some of which are susceptible to failure in high temperatures.

What is needed is a partial shroud fixed to the rotor blades of the compressor impeller to allow for control of the performance requirements without the unwanted loss of performance.

SUMMARY

In accordance with the present disclosure, there is provided a hybrid shroud impeller comprising a hub centered about a centerline defining an axis, the hub having a first axial end and a second axial end opposite the first axial end; the hub including an outer surface formed radially opposite a hub bore; at least one full blade extending radially from the outer surface; at least one splitter blade extending radially from the outer surface adjacent to the at least one full blade; a bleed feature formed in a casing; a partial shroud integrally formed with a portion of the at least one full blade and the at least one splitter blade opposite the outer surface of the hub; and a flow path formed between the outer surface of the hub, a shroud inner surface of the partial shroud and a blade surface of each of the at least one full blade and the at least one splitter blade; the flow path extending from an inlet proximate the first axial end and an outlet proximate the second axial end; wherein the partial shroud extends from the inlet to about the bleed feature.

A further embodiment of any of the foregoing embodiments may additionally and/or alternatively include the outer surface defines a hub flow surface that forms an innermost surface of the flow path.

A further embodiment of any of the foregoing embodiments may additionally and/or alternatively include at least one splitter blade extends a portion of a length of the flow path.

A further embodiment of any of the foregoing embodiments may additionally and/or alternatively include at least one full blade extends an entire length of the flow path, from the inlet adjacent second axial end to the outlet at the first axial end.

A further embodiment of any of the foregoing embodiments may additionally and/or alternatively include each of the at least one full blade and the at least one splitter blade are angled and/or bowed to extend at least partially in a circumferential direction relative to the centerline.

A further embodiment of any of the foregoing embodiments may additionally and/or alternatively include the partial shroud extends up to a first edge of the bleed feature.

A further embodiment of any of the foregoing embodiments may additionally and/or alternatively include the partial shroud extends up to a second edge of the bleed feature.

In accordance with the present disclosure, there is provided a hybrid shroud impeller comprising a hub centered about a centerline defining an axis, the hub having a first axial end and a second axial end opposite the first axial end; the hub including an outer surface formed radially opposite a hub bore; a set of full blades extending radially from the outer surface; a set of splitter blades extending radially from the outer surface between each full blade in the set of full blades; a bleed feature formed in a casing proximate the hub; a partial shroud integrally formed with a portion of each of the full blades and each of the splitter blades opposite the outer surface of the hub; and a flow path formed between the outer surface of the hub, a shroud inner surface of the partial shroud and a blade surface of each of the set of full blades and the set of splitter blades; the flow path extending from an inlet proximate the first axial end and an outlet proximate the second axial end; wherein the partial shroud extends from the inlet to a location proximate the bleed feature.

A further embodiment of any of the foregoing embodiments may additionally and/or alternatively include the set of splitter blades extend a portion of a length of the flow path, beginning at the inlet adjacent the second axial end and extending along flow path towards the first axial end short of extending an entire length of the flow path distal from the first axial end.

A further embodiment of any of the foregoing embodiments may additionally and/or alternatively include the partial shroud is annular in shape and the radially outermost component of the hybrid shroud impeller.

A further embodiment of any of the foregoing embodiments may additionally and/or alternatively include the partial shroud including a frustoconical shape that is similar to a shape of the outer surface of the hub with a diameter of the partial shroud adjacent the first axial end being smaller than another diameter of the partial shroud adjacent the inlet of the flow path near the second axial end.

A further embodiment of any of the foregoing embodiments may additionally and/or alternatively include the partial shroud is located proximate the bleed feature a distance of 1× a bleed feature cross sectional diameter.

A further embodiment of any of the foregoing embodiments may additionally and/or alternatively include the partial shroud extends on either side of the bleed feature by a length of about 100% of a length of the bleed feature.

In accordance with the present disclosure, there is provided a process for assembling a hybrid shroud impeller comprising forming a hub centered about a centerline defining an axis, the hub having a first axial end and a second axial end opposite the first axial end; the hub including an outer surface formed radially opposite a hub bore; extending a set of full blades radially from the outer surface; extending a set of splitter blades radially from the outer surface between each full blade in the set of full blades; forming a bleed feature in a casing proximate the hub; integrally forming a partial shroud with a portion of each of the full blades and each of the splitter blades opposite the outer surface of the hub; forming a flow path between the outer surface of the hub, a shroud inner surface of the partial shroud and a blade surface of each of the set of full blades and the set of splitter blades; extending the flow path from an inlet proximate the first axial end and an outlet proximate the second axial end; and extending the partial shroud from the inlet to a location proximate the bleed feature.

A further embodiment of any of the foregoing embodiments may additionally and/or alternatively include the process further comprising extending the partial shroud up to a first edge of the bleed feature.

A further embodiment of any of the foregoing embodiments may additionally and/or alternatively include the process further comprising extending the partial shroud up to a second edge of the bleed feature.

A further embodiment of any of the foregoing embodiments may additionally and/or alternatively include the process further comprising forming the partial shroud as an annular shape and the radially outermost component of the hybrid shroud impeller.

A further embodiment of any of the foregoing embodiments may additionally and/or alternatively include the process further comprising forming the partial shroud into a frustoconical shape that is similar to a shape of the outer surface of the hub with a diameter of the partial shroud adjacent the first axial end being smaller than another diameter of the partial shroud adjacent the inlet of the flow path near the second axial end.

A further embodiment of any of the foregoing embodiments may additionally and/or alternatively include the process further comprising forming an edge of the partial shroud into a shape selected from the group consisting of a circular smooth shape; a zigzag shape, a sine wave along a circumference shape; a parabolic shape and a serrated shape.

A further embodiment of any of the foregoing embodiments may additionally and/or alternatively include the process further comprising extending the partial shroud on either side of the bleed feature by a length of about 100% of a length of the bleed feature.

Other details of the hybrid shroud impeller are set forth in the following detailed description and the accompanying drawings wherein like reference numerals depict like elements.

DETAILED DESCRIPTION

Figure 1:
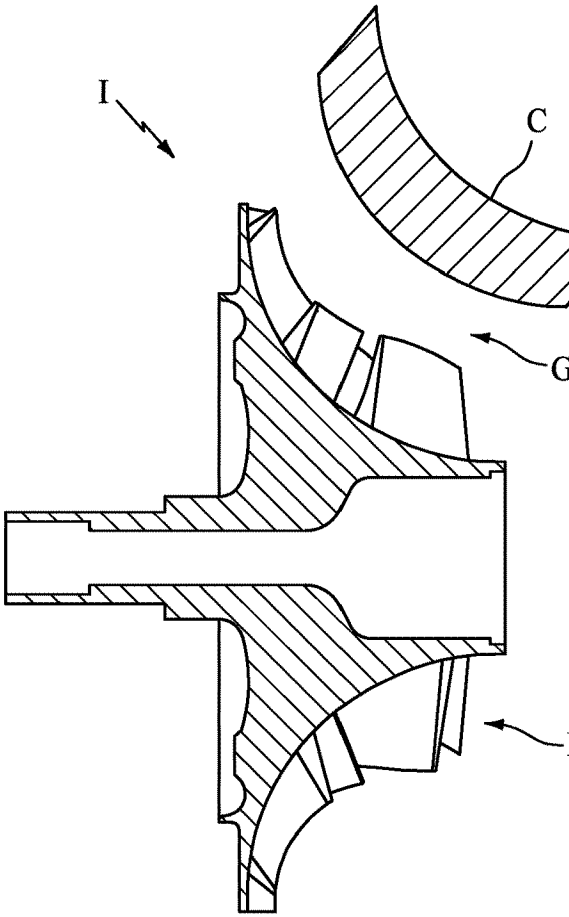
FIG. 1 (PRIOR ART)
FIG. 1 is a partial cross-sectional schematic representation of a prior art shroud-less impeller design.
Figure 2:
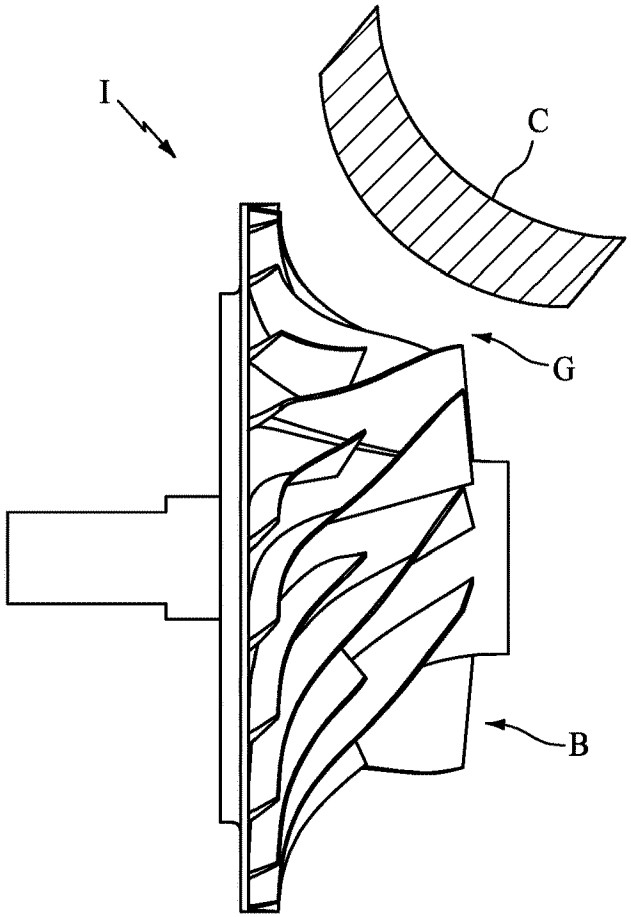
FIG. 2 (PRIOR ART)
FIG. 2 is a side view schematic representation of a prior art shroud-less impeller design.
Figure 3:
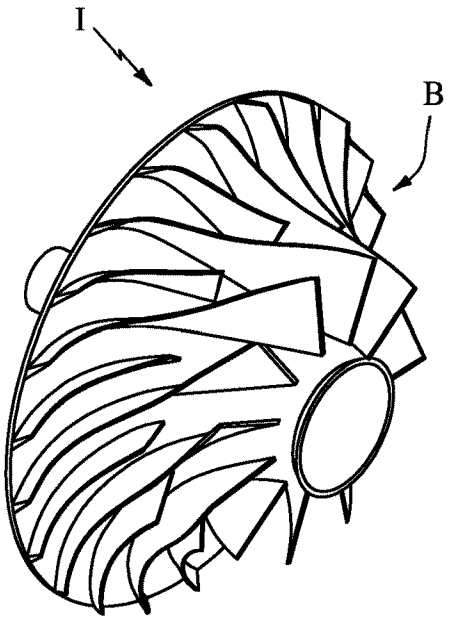
FIG. 3 (PRIOR ART)
FIG. 3 is an isometric view schematic representation of a prior art shroud-less impeller design.
Figure 5:
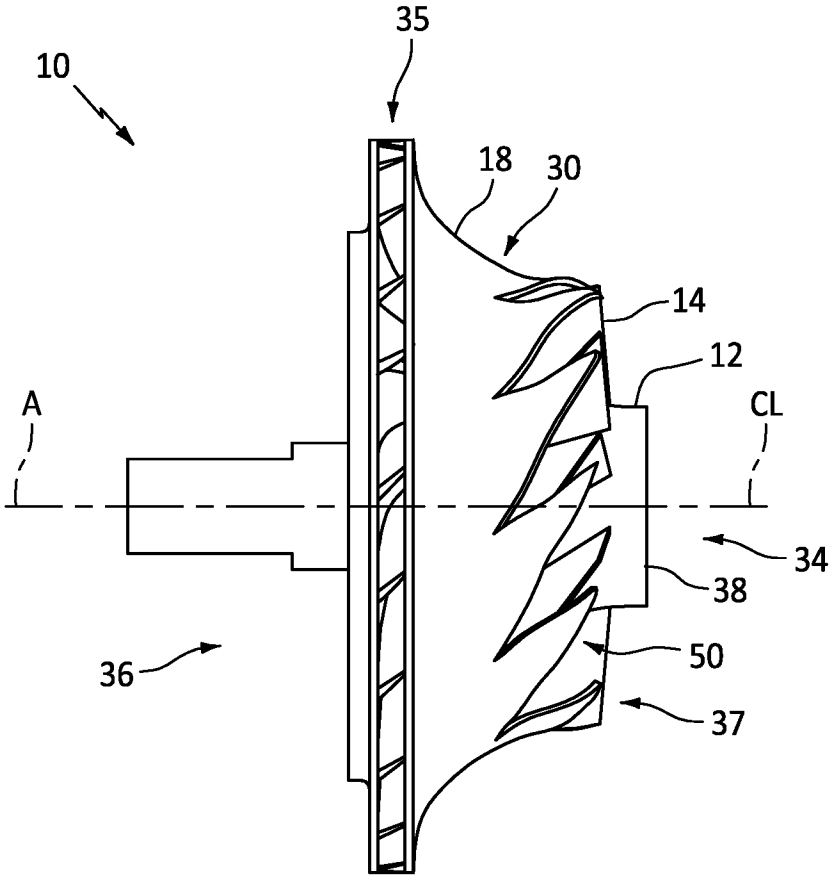
FIG. 5 is a side view schematic representation of an exemplary hybrid shroud impeller.
Figure 4:
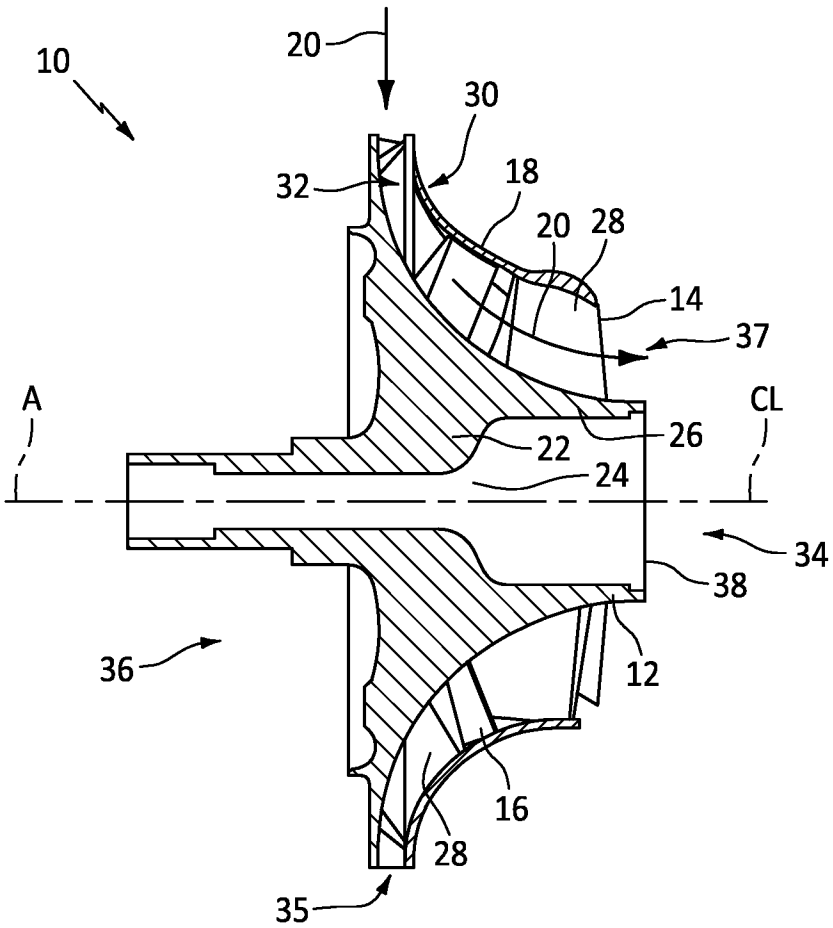
FIG. 4 is a partial cross-sectional schematic representation of an exemplary hybrid shroud impeller.
Figure 6:
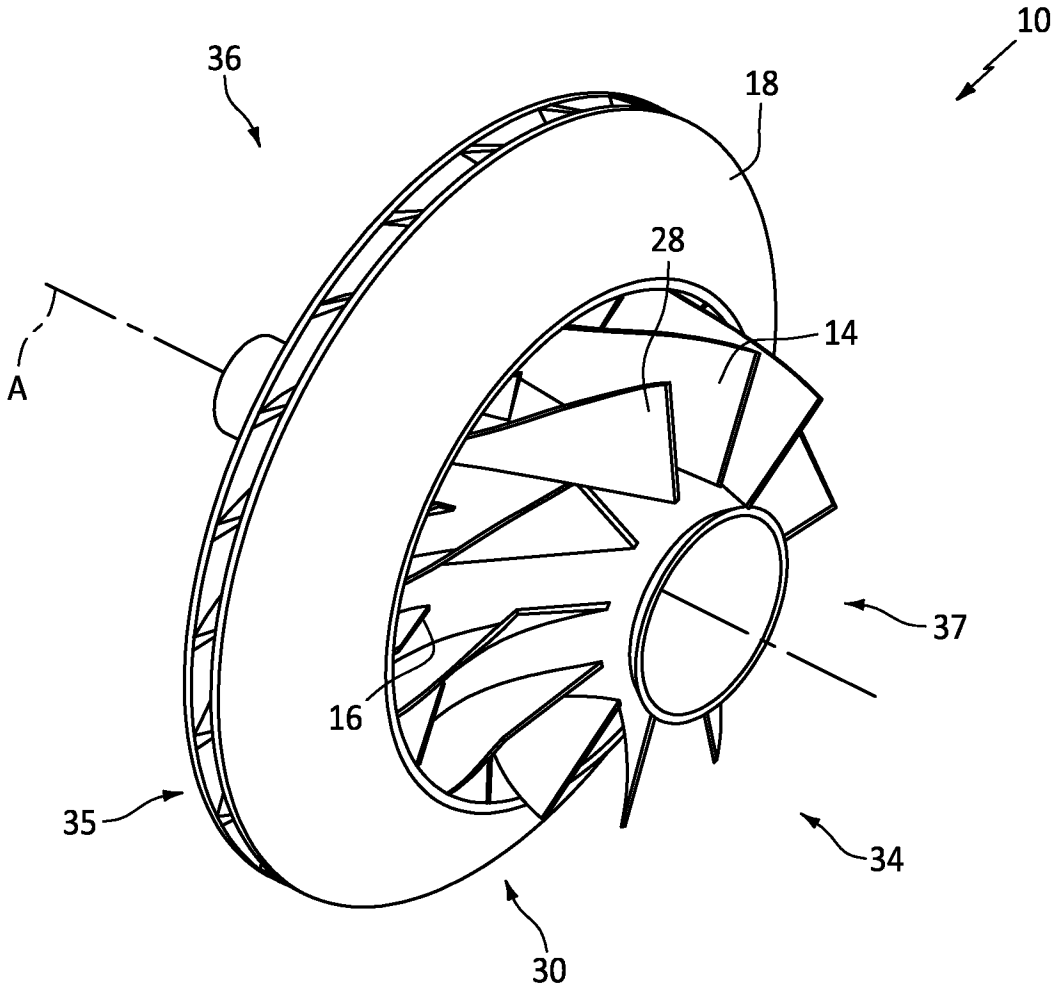
FIG. 6 is an isometric view schematic representation of an exemplary hybrid shroud impeller.
Figure 7:
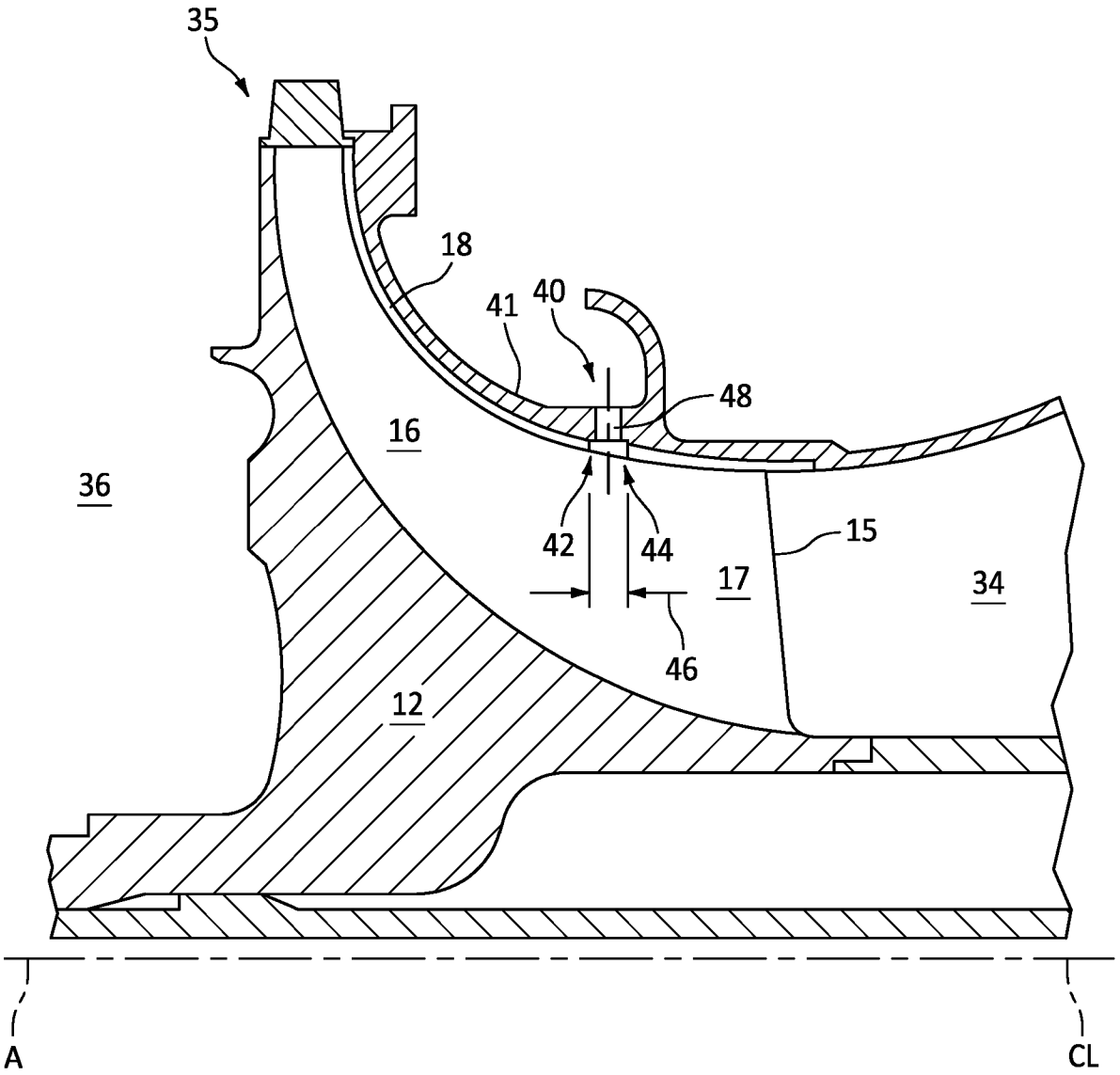
FIG. 7 is a cross-sectional schematic representation of an exemplary hybrid shroud impeller.

FIG. 4 is a cross sectional view of a hybrid shroud impeller 10, FIG. 5 is a side view of the hybrid shroud impeller 10 and FIG. 6 is an isometric view of the hybrid shroud impeller 10. The hybrid shroud impeller 10 includes a hub 12 which supports full blade(s) 14 and splitter blade(s) 16. A partial shroud 18 is connected to a portion of the full blade 14 and the splitter blade 16. In an exemplary embodiment, the partial shroud 18 is formed integral with the splitter blade 16 and integral with a portion of the full blade 14. The partial shroud 18 can be unitary with the full blade 14 and splitter blade 16 formed by additive manufacturing techniques and/or conventional manufacturing techniques.

A flow path 20 is formed between the hub 12, partial shroud 18 and at least one of the full blade 14 and splitter blade 16. The hub 12 includes a bore 22 at a radial center 24 proximate a centerline CL and an outer surface 26.

The full blade 14 and splitter blade 16 include a blade surface 28. The partial shroud 18 includes a radial outer side 30 and shroud inner surface 32 opposite the radial outer side 30. The hybrid shroud impeller 10 includes a first axial end 34 and a second axial end 36 opposite the first axial end 34. A seal 38 is formed proximate the first axial end 34 on the hub 12.

The hybrid shroud impeller 10 is a rotating component (about axis A defined by centerline CL) within an auxiliary power unit (APU) radial compressor that provides flow path 20 through which air that is conditioned flows to eventually be provided to a fuselage of an aircraft. In addition, a similar hybrid impeller can be used in power head/gas turbine applications. Hybrid shroud impeller 10 can be radially outward from and centered about a shaft (not shown) along axis A (which extends through bore 22 of hub 12) that extends along centerline CL. Hybrid shroud impeller 10 is shown as having a substantially frustoconical shape with flow path 20 providing a path for air to enter at an inlet 35 adjacent second axial end 36 by flowing radially inward, change direction while flowing through flow path 20 formed within hybrid shroud impeller 10, and exit flow path 20 at an outlet 37 adjacent first axial end 34 by flowing in an axial direction parallel to centerline CL. While hybrid shroud impeller 10 is shown as being substantially frustoconical, hybrid shroud impeller 10 can have other configurations, such as a cylindrical configuration in which flow path 20 is parallel to centerline C.

Hybrid shroud impeller 10 can be constructed from a variety of materials, such as steel and/or titanium alloys or aluminum silicone alloys, but the material should be suitable to be used in an additive manufacturing process as well as conventional manufacturing process while also being able to be machined to provide a smooth surface to the flow surfaces of flow path 20.

Hub 12 is annular in shape extending axially along centerline CL. Hub 12 is centered about centerline CL at radial center 24. Hub 12 includes bore 22 at radial center 24 that provides an aperture through which a shaft of the APU can extend. Hub 12 also includes outer surface 26 forming the radially outward most part of hub 12, with outer surface 26 being a flow surface that forms the innermost surface of flow path 20. Hub 12 can be frustoconical (as shown in the disclosed embodiment) with first axial end 34 having a cross section with a smaller diameter than a diameter of a cross section at second axial end 36.

Full blades 14 and splitter blades 16 extend outward from hub 12 and extend between the hub 12 and partial shroud 18. Full blades 14 and splitter blades 16 extend substantially radially outward from hub 12, but near second axial end 36 full blades 14 are axially forward of hub 12 (with forward being a direction to the right of the page in FIGS. 4-6) due to the changing direction of flow path 20. Full blades 14 and splitter blades 16 can also be classified as rotors because full blades 14 and splitter blades 16 rotate along with the other components of hybrid shroud impeller 10. Splitter blades 16 extend only a portion of a length of flow path 20, beginning at the inlet adjacent second axial end 36 and extending along flow path 20 towards first axial end 34 but not extending the entire length of flow path 20 to first axial end 34. Full blades 14 can extend the entire length of flow path 20, beginning at the inlet adjacent second axial end 36 and ending at the outlet at first axial end 34. Both full blades 14 and splitter blades 16 can be angled and/or bowed (or have other features) such that the blades 14, 16 extend at least partially in a circumferential direction. Full blades 14 and splitter blades 16 can have a variety of configurations to guide the flow of air through flow path 20. Additionally, other configurations of blades do not have to include full blades 14 and splitter blades 16. Full blades 14 and splitter blades 16 include blade surface 28, which are exposed to air flowing through flow path 20.

The partial shroud 18 is annular in shape and the radially outermost component of the hybrid shroud impeller 10. The partial shroud 18 includes radial outer side 30 on the radially outermost side and shroud inner surface 32 forming the radially outer boundary/wall of flow path 20. The partial shroud 18 can extend axially proximate second axial end 36 from the inlet of flow path 20 to a location proximate a slot or bleed feature (slot) 40 formed in a static hardware 41, such as an air inlet housing or casing, such that partial shroud 18 does not extend an entire axial length of hybrid shroud impeller 10. The casing 41 can be proximate the blades 14, 16. The partial shroud 18 can have a frustoconical shape that is similar to the shape of outer surface 26 of hub 12 with a diameter of partial shroud 18 adjacent first axial end 34 being smaller than a diameter of partial shroud 18 adjacent the inlet of flow path 20 closer to second axial end 36.

In an exemplary embodiment, the partial shroud 18 can extend up to a first edge 42 of bleed feature (slot) 40. In an exemplary embodiment the partial shroud 18 can extend up to a second edge 44 of bleed feature (slot) 40. In another exemplary embodiment, the partial shroud 18 can be located on either side of bleed feature (slot) 40 by a length of about 100% of a length 46 of the bleed feature (slot) 40. In another exemplary embodiment, the partial shroud 18 can be located proximate the bleed feature (slot) 40 at a distance of 1× a bleed feature (slot) cross sectional diameter dimension 48. The bleed feature (slot) 40 can be located proximate a location near the splitter blade 16 end 17 and proximate an end 15 of the full blade 14.

The partial shroud 18 can include a variety of shapes along an edge 50 proximate the first axial end 34. For example, the edge 50 shape is not limited to circular smooth shapes. The edge 50 can include a variety of shapes including a zigzag, sine wave along a circumference or a parabolic shape. The edge 50 can be serrated. The technical effect of the serrated zigzag shape along the circumference provides reduced flow and increased pressure. Without the serrated zigzag shape along the circumference provides increased flow and reduced pressure. The shape of the edge 50 can be tailored to optimize the flow and pressure, and stability of the compressor.

A technical advantage of the disclosed hybrid shroud impeller can include no blade damage with a resultant increase the life of the impeller.

Another technical advantage of the disclosed hybrid shroud impeller can include performance improvement since there are minimum losses due to churning of the flow.

Another technical advantage of the disclosed hybrid shroud impeller can include improvement in the operability and performance of the impeller with minimum increase in engine weight.

Another technical advantage of the disclosed hybrid shroud impeller can include a light-weight air inlet housing, due to minimal changes to the housing casting (reuse same casting tool).

Another technical advantage of the disclosed hybrid shroud impeller can include benefits in fine tuning critical speed by mass impact at lower frequencies.

Another technical advantage of the disclosed hybrid shroud impeller can include assembly process improvement as a result of the elimination of tight tolerances between impeller and casing.

Another technical advantage of the disclosed hybrid shroud impeller can include a Power head impeller with hybrid shroud, while load impeller+IGV with full shroud can be implemented, vice-versa.

Another technical advantage of the disclosed hybrid shroud impeller can include a reduction in vibration levels due to rubbing effect between blade tip and casing being minimized.

Another technical advantage of the disclosed hybrid shroud impeller can include a debris containment improvement.

Another technical advantage of the disclosed hybrid shroud impeller can include a hybrid shroud impeller constructed with Additive Manufacturing for types of impeller (load impeller and power head impeller).

Another technical advantage of the disclosed hybrid shroud impeller can include the elimination of the abradable structure by incorporating the hybrid shroud impeller.

Another technical advantage of the disclosed hybrid shroud impeller can include natural frequencies of both type blades (full and splitter) are higher due to stiffness impact at higher frequencies.

There has been provided a hybrid shroud impeller. While the hybrid shroud impeller has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A hybrid shroud impeller assembly comprising:

a hub centered about a centerline defining an axis, the hub having a first axial end and a second axial end opposite the first axial end; the hub including an outer surface formed radially opposite a hub bore;

at least one full blade extending radially from the outer surface;

at least one splitter blade extending radially from the outer surface adjacent to the at least one full blade;

a bleed feature formed in a casing;

a partial shroud integrally formed with a portion of the at least one full blade and the at least one splitter blade opposite the outer surface of the hub; and a flow path formed between the outer surface of the hub, a shroud inner surface of the partial shroud and a blade surface of each of the at least one full blade and the at least one splitter blade; the flow path extending from an inlet proximate the first axial end and an outlet proximate the second axial end; wherein the partial shroud extends from the inlet to about the bleed feature.

2. The hybrid shroud impeller assembly according to claim 1, wherein the outer surface defines a hub flow surface that forms an innermost surface of the flow path.

3. The hybrid shroud impeller assembly according to claim 1, wherein the at least one splitter blade extends a portion of a length of the flow path.

4. The hybrid shroud impeller assembly according to claim 1, wherein the at least one full blade extends an entire length of the flow path, from the inlet adjacent the second axial end to the outlet at the first axial end.

5. The hybrid shroud impeller assembly according to claim 1, wherein each of the at least one full blade and the at least one splitter blade are angled and/or bowed to extend at least partially in a circumferential direction relative to the centerline.

6. The hybrid shroud impeller assembly according to claim 1, wherein the partial shroud extends up to a first edge of the bleed feature.

7. The hybrid shroud impeller assembly according to claim 1, wherein the partial shroud extends up to a second edge of the bleed feature.

* * * * *